US006693618B2

(12) United States Patent
Son et al.

(10) Patent No.: US 6,693,618 B2
(45) Date of Patent: Feb. 17, 2004

(54) LIQUID CRYSTAL DISPLAY DEVICE AND DRIVING METHOD FOR THE SAME

(75) Inventors: Hyeon-Ho Son, Annyang (KR); Ku-Hyun Park, Annyang (KR)

(73) Assignee: LG. Philips LCD Co., Ltd, Seoul (KR)

( * ) Notice: Subject to any disclaimer, the term of this patent is extended or adjusted under 35 U.S.C. 154(b) by 214 days.

(21) Appl. No.: 10/028,985

(22) Filed: Dec. 28, 2001

(65) Prior Publication Data

US 2003/0006948 A1 Jan. 9, 2003

(30) Foreign Application Priority Data

Jul. 9, 2001 (KR) ..... 2001-40737

(51) Int. Cl.[7] ..... G09G 3/36

(52) U.S. Cl. ..... 345/99; 345/94; 345/95; 345/96

(58) Field of Search ..... 345/90, 87, 94, 345/95, 96, 98, 99, 100, 208, 209

(56) References Cited

U.S. PATENT DOCUMENTS 5,151,803 A * 9/1992 Wakita et al. ..... 345/97
5,648,793 A * 7/1997 Chen ..... 345/96
5,734,367 A * 3/1998 Tsuboyama et al. ..... 345/101
5,815,131 A * 9/1998 Taniguchi et al. ..... 345/94

* cited by examiner

*Primary Examiner*—Kent Chang
(74) *Attorney, Agent, or Firm*—McKenna Long & Aldridge LLP

(57) ABSTRACT

A liquid crystal display device in which a actual image and a black image are displayed alternately in a frame to prevent motion blur. A black image gate pulse and an actual image gate pulse are overlapped between two spaced scanning lines at an arbitrary moment of a frame to pre-charge a pixel voltage applied to pixels of the overlapped scanning line. The liquid crystal display device further includes a line memory that outputs a data signal to a data integrated circuit by dividing the data signal into at least two data signals to increase a data processing speed.

17 Claims, 9 Drawing Sheets

LIQUID CRYSTAL DISPLAY DEVICE AND DRIVING METHOD FOR THE SAME

This application claims the benefit of Korean Patent Application No. 2001-40737, filed on Jul. 9, 2001 in Korea, which is hereby incorporated by reference for all purposes as if fully set forth herein.

BACKGROUND OF THE INVENTION

1. Field of the Invention

The present invention relates to a liquid crystal display device, and more particularly, to a liquid crystal display device and a method of driving the liquid crystal display device.

2. Discussion of the Related Art

Liquid crystal display devices have been gaining in popularity in the display field because of their low power consumption and superior portability. Generally, the liquid crystal display device comprises a lower substrate, also referred to as an array substrate, an upper substrate, also referred to as a color filter substrate, and interposed liquid crystal between the upper substrate and the lower substrate. The lower substrate includes a thin film transistor. The upper substrate includes a color filter. Liquid crystal display devices use optical anisotropy and polarization properties of liquid crystals to display images. Presently, active matrix LCD (AM LCD) devices are one of the most popular means for displaying images because of their high resolution and superiority in displaying moving images. Accordingly, for purposes of discussion, all liquid crystal display devices hereinafter described refer to active matrix LCD (AM LCD) devices.

FIG. 1 illustrates a schematic view of a liquid crystal panel used in a conventional liquid crystal display device. As shown in FIG. 1, a liquid crystal panel 2 includes an upper substrate 4 having a common electrode (not shown), and a lower substrate 6 having a pixel electrode (not shown). A liquid crystal layer 8 is interposed between the upper substrate 4 and the lower substrate 6. A gate integrated circuit 10 and a data integrated circuit 12, used for applying a gate signal and a data signal, respectively, are positioned on the left and upper portion of the liquid crystal panel 2, respectively. A plurality of scanning lines $g_i$, where "i" is a positive integer and $1 \leqq i \leqq n$, are provided to receive a gate signal and a plurality of signal lines $d_j$, where "j" is a positive integer and $1 \leqq j \leqq m$, are provided to receive a data signal on the lower substrate 6. The scanning lines and the signal lines cross each other to define a pixel region. A plurality of thin film transistors are formed at the crossing of the scanning lines and the signal lines. A liquid crystal capacitor $C_{LC}$ and a storage capacitor $C_{ST}$ are connected in parallel to the thin film transistor.

A conventional driving method of the abovementioned liquid crystal display device will now be described with reference to FIGS. 2A–2C, 3A, 3B, and 4. Generally, the duration of time that the gate signal is applied to the scanning line such that the scanning line is in an "on-state" is called a selection time. Conventional driving methods apply a higher voltage to the gate, which is connected to the scanning line, than a voltage applied to the signal line to reduce a resistance of a channel between a source electrode and a drain electrode during the selection time. Accordingly, the voltage applied to the signal line, also becomes applied to the liquid crystal layer through the pixel electrode. Conventional driving methods further apply lower voltage to the gate than a voltage applied to the signal line to electrically sever the source electrode and the drain electrode during a non-selection time. Accordingly, the electric charge accumulated in the liquid crystal layer during the selection time is maintained. By causing each scanning, line, from the first to the last, to undergo a selection time and a non-selection time, a frame of an image is made.

Referring to FIG. 2A, a timing chart illustrates a gate pulse applying method for each frame of a liquid crystal display device according to the related art. As shown in the FIG. 2A, all scanning lines of one frame are selected by applying an on-off gate pulse sequentially from the first scanning line $g_1$ to the $i_{th}$ scanning line $g_1$. For example, a first gate pulse 14*a* of a first frame and a second gate pulse 14*b* of a second frame are sequentially applied only once to pixels of the corresponding scanning line. After the first scanning line $g_1$ undergoes the on-off of the gate pulse 14, the first scanning line $g_1$ should maintain an alignment of the liquid crystal for one frame period until the gate pulse 14 is applied to the $i_{th}$ scanning line $g_i$. This driving method is referred to as a hold type driving method.

Referring to FIG. 2B, another timing chart illustrates a method of processing image information for each frame in the hold type driving method. As shown in FIG. 2B, the hold type driving method maintains uniform image information for one frame. This processing method is possible only when a response speed of the liquid crystal equal to a speed of processing image information. However, twisted nematic (TN) liquid crystal, which is typically used in conventional liquid crystal display devices, has a response speed of 20 msec. The response speed of the liquid crystal within the liquid crystal display device, driven according to the hold type driving method, cannot catch up with the image information processing speed because a response speed of the liquid crystal suitable for motion picture must be at least under 5 msec. Accordingly, deterioration of displayed images occurs and results in a blurred motion of an image because the image information of the previous frame also remains in the next frame. Referring to FIG. 2B, the difference in height of the image information region for each frame indicates a gray level difference.

Referring to FIG. 2C, a chart illustrates a screen processing method of a hold type liquid crystal display device according to related art. As shown in FIG. 2C, at an arbitrary time, only image information on the selected scanning line 17 is refreshed. The selected scanning line 17 receives the image information of a new frame and, if the response speed of the liquid crystal cannot catch up with the image information processing speed, the image of the previous frame remains in the corresponding pixels of the selected scanning line 17 and thereby blurred motion results. Additionally, a data signal voltage, applied through the data integrated circuit, has a voltage different from a pixel voltage, applied to the pixel, due to resistance between lines in the course of arriving at the pixel or a parasitic capacitance in a portion of the thin film transistor. This voltage difference causes an image information difference between desired image information and actual image information. This image information difference brings about blurred motion in terms of visual perception.

Referring to FIG. 3A, a timing chart illustrates light emission profiles of a conventional cathode cay tube (CRT) display device. FIG. 3B illustrates a timing chart for a lighting operation curve of a conventional liquid crystal display device. In FIG. 3A, the light emission profile is individually formed for each frame by placing a black image section "I", which makes a light intensity to become zero in a frame. As shown in FIG. 3B, because the liquid crystal display device uses a hold type driving method, and maintains fixed image form each frame, a continuous lighting operation curve is formed. An error region "II" between the lighting operation curve and the data signal voltage brings about more blurred motion of an image as the frame is repeated. To overcome the above problem, a light emission profile according to two steps for each pixel is needed.

Referring to FIG. 4, a timing chart illustrates a related art method of processing image information for each frame in a liquid crystal display device using an impulsive type driving method. In the impulsive driving method, a certain portion of each frame is allocated a black image section "III" to prevent the image information of the previous frame from affecting the present frame. A double speed driving type liquid crystal display device, having a gate pulse with a short gate pulse width about ½ of the typical gate pulse width applied twice per frame using the impulsive driving method, has been suggested. However, because charging of the data signal voltage in the pixel is generally possible only when the gate signal voltage is in an "on-state", device properties within the thin film transistors within the liquid crystal devices need to be improved to increase the data processing speed. Accordingly, because a thin film transistor having a high field effect mobility is required to improve the device properties of the thin film transistor, choices for the semiconductor material is limited.

SUMMARY OF THE INVENTION

Accordingly, the present invention is directed a liquid crystal display device and a driving method for the liquid crystal display device that substantially obviates one or more of problems due to limitations and disadvantages of the related art.

An advantage of the present invention is to provide a liquid crystal display device that has a controller and a line memory to increase a data processing speed.

Another advantage of the present invention provides a driving method of the liquid crystal display device, in which an actual image and a black image are displayed alternately in a frame to prevent motion blur wherein a black image gate pulse and an actual image gate pulse are overlapped between two spaced scanning lines at an arbitrary moment of a frame to pre-charge a pixel voltage of pixels of the overlapped scanning line.

Additional features and advantages of the invention will be set forth in the description which follows, and in part will be apparent from the description, or may be learned by practice of the invention. Other advantages of the invention will be realized and attained by the stricture particularly pointed out in the written description and claims hereof as well as the appended drawings.

To achieve these and other advantages and in accordance with the purpose of the present invention, as embodied and broadly described, a liquid crystal display device comprises a liquid crystal panel including a plurality of scanning lines, a plurality of signal lines, a first substrate, a second substrate, and a liquid crystal layer interposed between the first substrate and the second substrate, wherein the scanning lines receive a gate signal, the signal lines receive a data signal and define a pixel region by crossing the scanning line, the first substrate includes a switching element that is connected to the scanning line and the signal line, the second substrate includes a common electrode, a gate integrated circuit and a data integrated circuit applies the gate signal and the data signal to the scanning line and the signal line, respectively, and a controller, wherein the controller outputs a gate start pulse for a reset image information and a gate start pulse for an actual image information to the gate integrated circuit at least once in a frame and controls a gate pulse for the reset image information and a gate pulse for the actual image information to be overlapped between two spaced scanning lines at an arbitrary moment. The liquid crystal display device further includes a line memory that stores the data signal of the controller and outputs the stored data signal to the data integrated circuit by dividing the data signal into at least two data signals and the controller outputs at least two data start pulses to each data integrated circuit, correspondingly, to a division method of the line memory. The line memory outputs the data signal to the data integrated circuit by dividing the data signal into three data signals. The liquid crystal is an optically compensated birefringence (OCB) mode liquid crystal that shows a bent structure when a voltage is applied. In one aspect of the invention, a normally white mode is adopted for the liquid crystal panel. The reset image information is black image information.

In another aspect, a driving method of a liquid crystal display device comprises the steps of applying a reset image data signal to corresponding pixels by sequentially applying a first gate pulse corresponding to a reset image information to each scanning line at a frame, and controlling the first gate pulse and a second gate pulse to be overlapped between two spaced scanning lines at an arbitrary moment in the first frame when the second gate pulse corresponding to an actual image information is sequentially applied to each scanning line with a certain time interval from the first gate pulse at the frame. The driving method of the liquid crystal display device further includes controlling a reset image data signal to be applied to an overlapped section of the first gate pulse and the second gate pulse, and controlling an actual image data signal to be successively applied to a non-overlapped section of the second gate pulse. A voltage that is applied to pixels of the overlapped section serves to pre-charge the successive actual image information. The reset image information is black image information. The first gate pulse precedes the second gate pulse. A reset image data and an actual image data, which are applied to the pixels to which the first gate pulse and the second gate pulse are applied, have a same polarity. A width of the first gate pulse has enough width to pre-charge the reset image data, and the reset image data is simultaneously applied to the scanning line to which the first gate pulse is applied and the scanning line to which the second gate pulse is applied in the overlapped section of the first gate pulse and the second gate pulse, and the actual image data is applied to the pixels of the scanning line to which the second gate pulse is applied in the section where only the second gate pulse is applied. The width of the first gate pulse and a width of the second gate pulse are different from each other. A size of a region in which the black image is displayed in a whole screen is controlled by a ratio between a first section that is from a start point of the first gate pulse to a start point of the second gate pulse in a frame and a second section that is from a start point of the second gate pulse in the frame to a start point of the first gate pulse in a next frame. A size of the first section and a size of the second section are different from each other. Both of the first section and the second section are longer than a response time of liquid crystal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the embodiment of the present invention, example of which is illustrated in the accompanying drawings.

Figure 1:
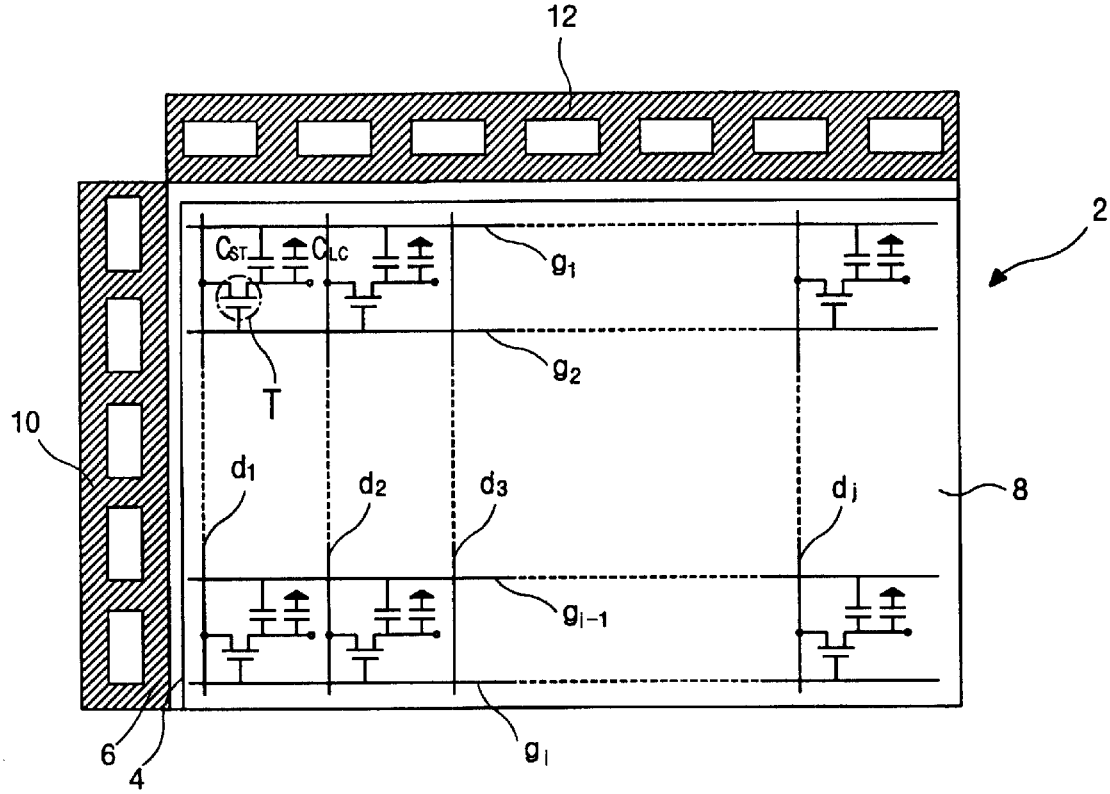
(RELATED ART) FIG.1
FIG. 1 illustrates a schematic view of a structure of a liquid crystal panel for a conventional liquid crystal display device.
Figure 2A:
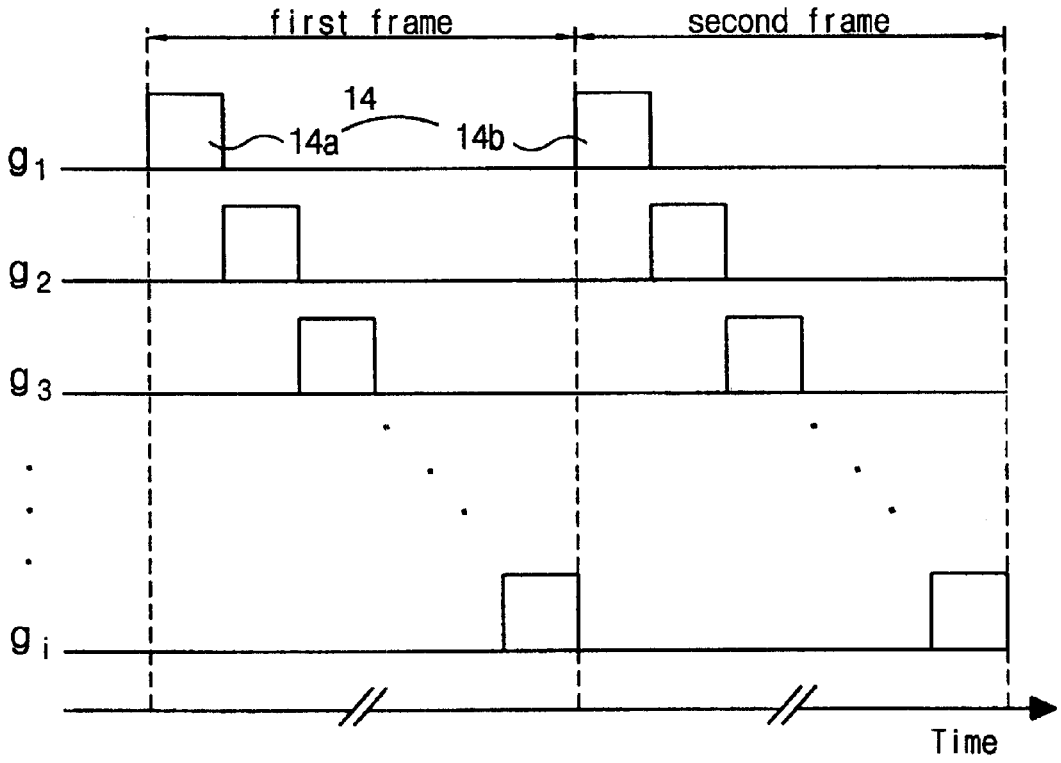
(RELATED ART) FIG.2A
FIG. 2A is a timing chart illustrating a gate pulse applying method for each frame of a liquid crystal display device according to the related art.
Figure 2B:
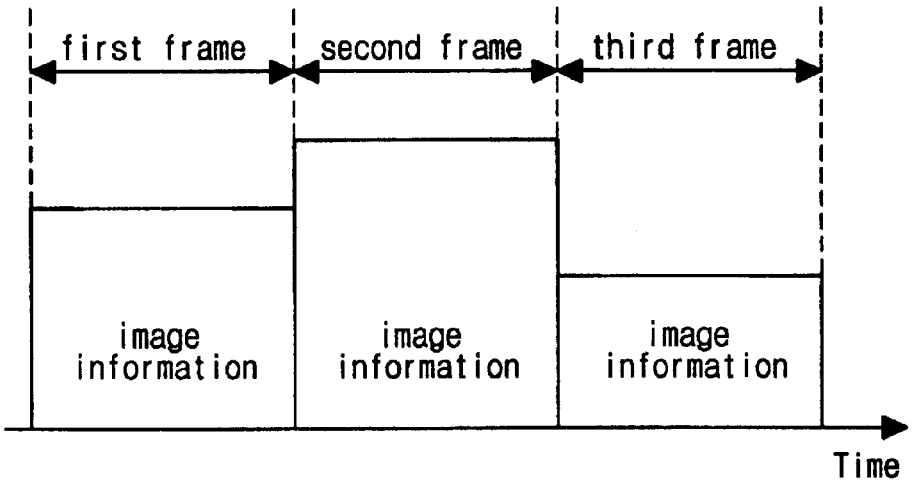
(RELATED ART) FIG.2B
FIG. 2B is a timing chart illustrating a structuring method of image information for each frame of a hole type liquid crystal display device according to the related art.
Figure 2C:
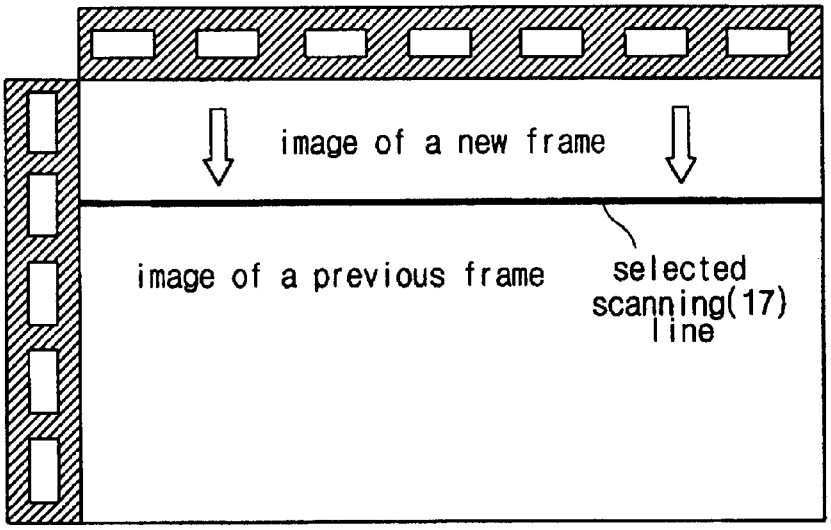
(RELATED ART) FIG.2C
FIG. 2C illustrates a view of a screen processing method of a hold type liquid crystal display device according to related art.
Figure 3A:
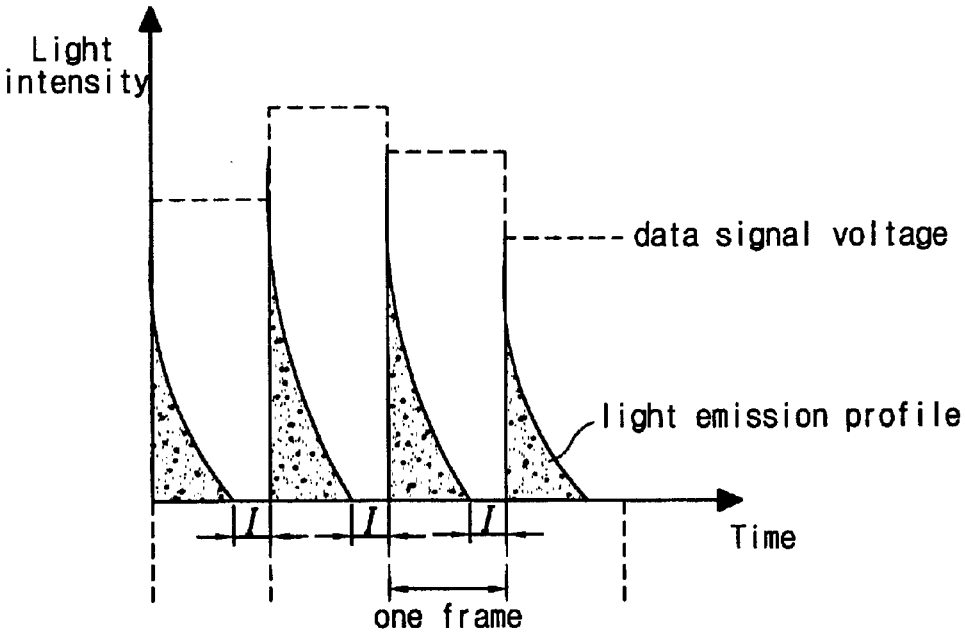
(RELATED ART) FIG.3A
FIG. 3A is a timing chart illustrating light emission profiles of a conventional cathode cay tube (CRT) display device.
Figure 3B:
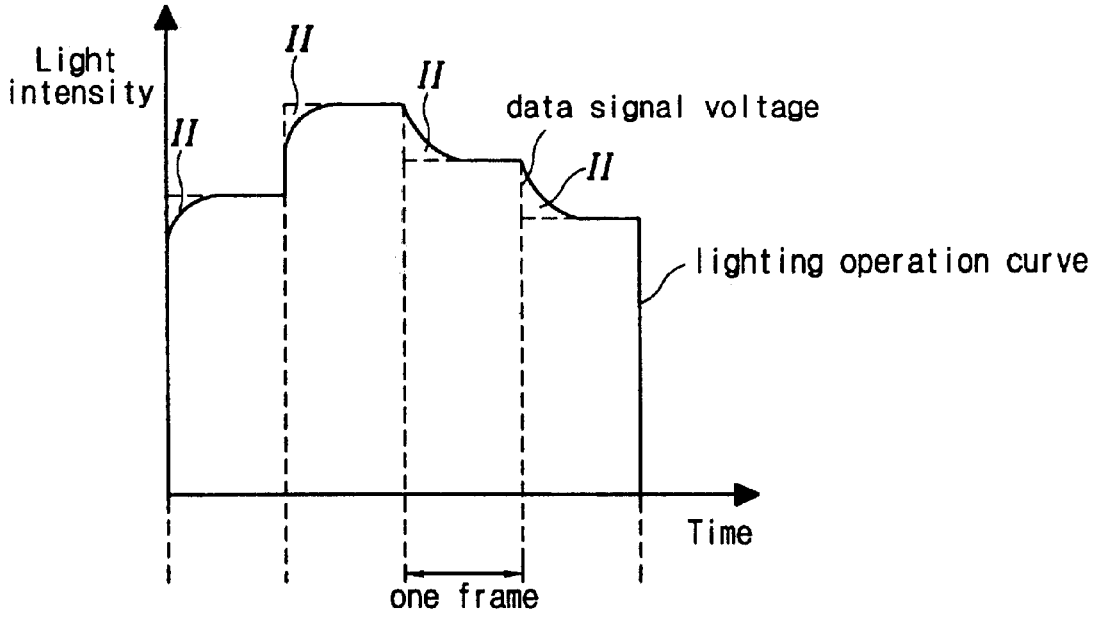
(RELATED ART) FIG.3B
FIG. 3B is a timing chart illustrating a lighting operation curve of a conventional liquid crystal display device.
Figure 4:
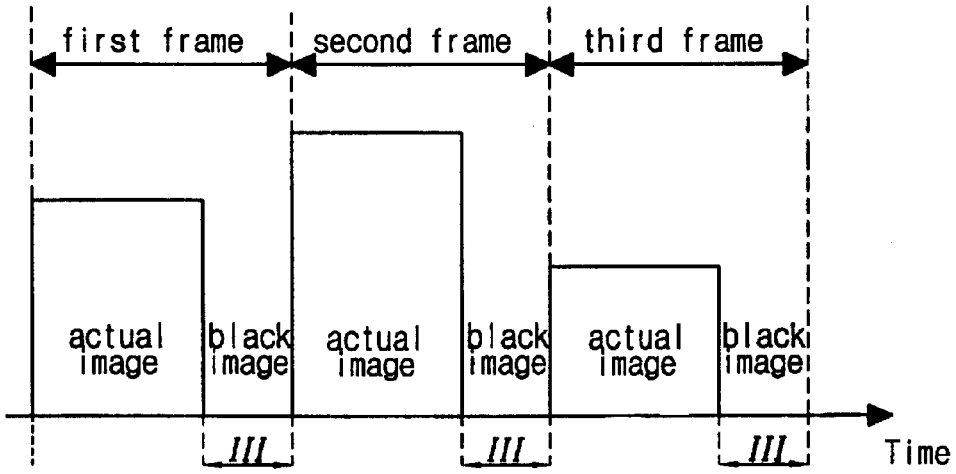
(RELATED ART) FIG.4
FIG. 4 is a timing chart illustrating a processing method of image information for each frame of an impulsive type liquid crystal display device according to the related art.
Figure 5:
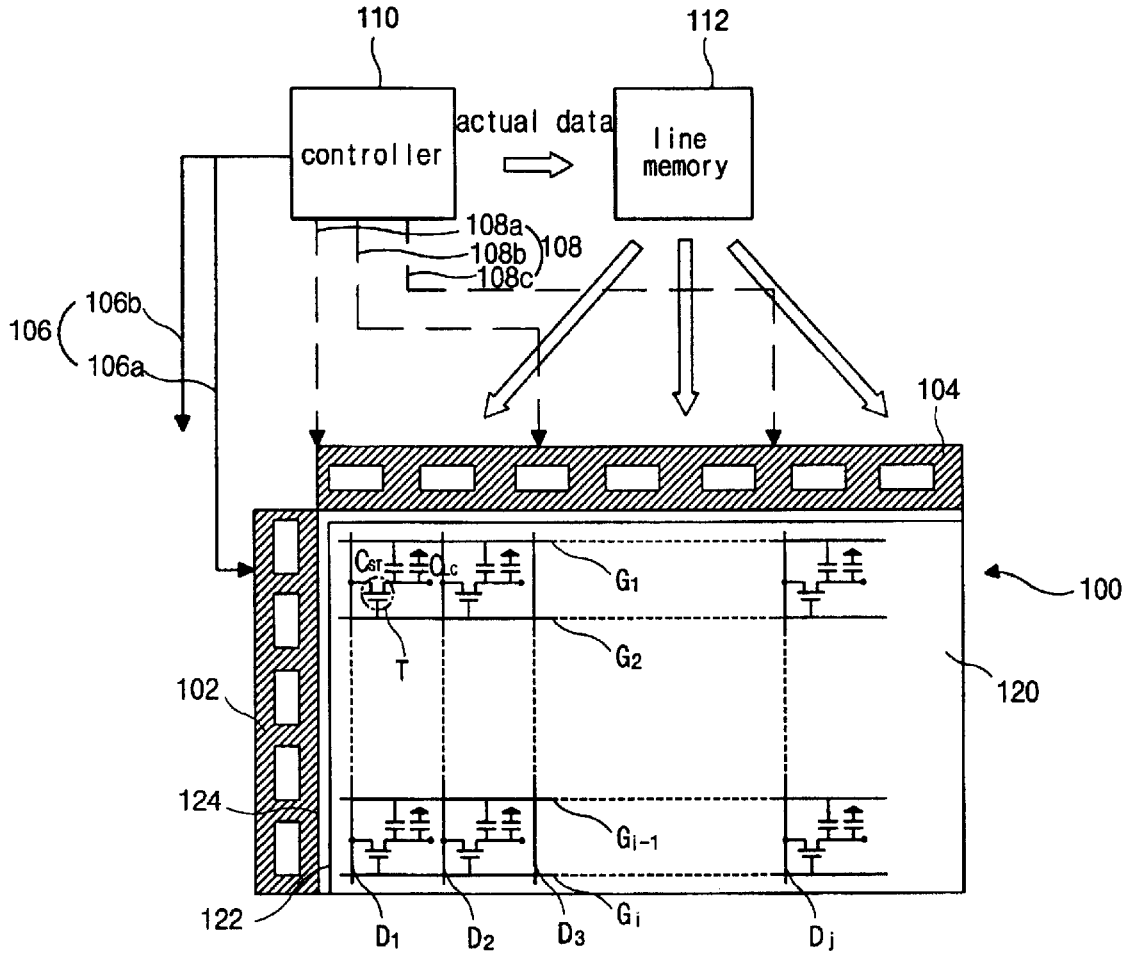
FIG. 5 is a schematic view illustrating a liquid crystal panel and a driving circuit for a liquid crystal display device according to the present invention.

Referring to FIG. 5, a schematic view illustrates a liquid crystal panel and a driving circuit for a liquid crystal display device according to the present invention. As shown in the FIG. 5, a liquid crystal panel 100 includes a first substrate 122 including a common electrode (not shown), and a second substrate 124 including a pixel electrode (not shown). A liquid crystal layer 120 is interposed between the first substrate 122 and the second substrate 124. A gate integrate circuit 102 which applies a plurality of gate signals, and a data integrated circuit 104 which applies a plurality of data signals, are formed on the second substrate 124. A controller 110 classifies image signals, inputted externally, into control signals and data signals. The controller 110 further applies a gate start pulse 106 and a data start pulse 108, which are collectively referred to as the control signals, to the gate integrated circuit 102 and the data integrated circuit 104, respectively, connected to the liquid crystal panel 100. A line memory 112, stores the data signal form the controller. 110 and dividedly applies the stored data signals to the corresponding data integrated circuit 104 connected to the liquid crystal panel 100. The controller 110 enables the data signal to be inputted to the data integrated circuit 104 faster than before by dividedly applying the data start pulse 108 to the corresponding data integrated circuit 104. The speed of the data signal input to the data integrated circuit 104 becomes faster according to a number of divisions of the data signal. In one aspect of the present invention, the data signal is divided into three data signals and, thus, the corresponding data start pulse 108 is divided into a first data start pulse 108*a*, a second data start pulse 108*b*, and a third data start pulse 108*c*. Though it may desirable to divide the data signal into three components, the data signal may be divided into two components. Moreover, the data signal may be divided into more than three components. A plurality of scanning lines $G_i$, where "i" is a positive integer $1 \leqq i \leqq n$, are provided to receive a gate signal from the gate integrated circuit and a plurality of signal line $D_j$, where "j" is a positive integer and $1 \leqq j \leqq m$ are provided to receive a data signal from the data integrated circuit are provided on the second substrate 124. The scanning lines and the signal lines cross each other to define a pixel region. A plurality of thin film transistors are formed at the crossing of the scanning lines and the signal lines. A liquid crystal capacitor $C_{LC}$, maintaining an alignment of liquid crystal for a frame, and a storage capacitor $C_{ST}$, maintaining a uniform electric charging of the pixel electrode, are connected in parallel to the thin film transistor.

The gate start pulse 106 for a frame, provided by the controller 110, consists of a first gate start pulse 106*a* and a second gate start pulse 106*b* which are outputted with a time interval between each other. Though it is not shown in the FIG. 5, the time interval between the first gate start pulse 106*a* and the second gate start pulse 106*b* can be controlled by a gate output enabler (GOE). Whereas the gate output enabler (GOE) is simultaneously connected to a plurality of gate integrated circuits and thus a gate pulse vibration width is controlled by a certain pulse according to the related art, the gate output enabler (GOE) can be formed for each gate integrated circuit 102 to place a black image section, i.e., a reset section, between actual image sections in the present invention. The driving of the gate output enabler (GOE) is controlled by the controller 110. It is desirable to use an optically compensated birefringence (OCB) mode liquid crystal, which shows a bent structure when a voltage is applied and thus has a fast response time in the liquid crystal panel 100 in the present invention. For example, the response time of the optically compensated birefringence (OCB) mode liquid crystal can be under 5 msec. In one aspect of the invention, a normally white mode is adopted for the liquid crystal panel of the present invention.

Figure 6:
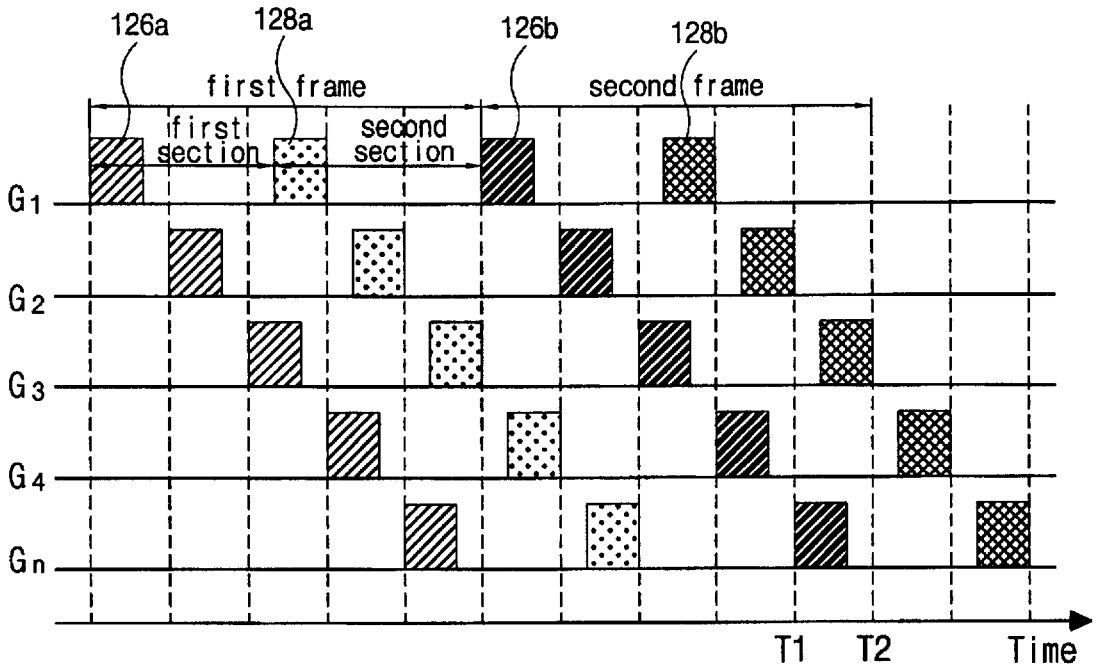
FIG. 6 is a timing chart illustrating a gate pulse applying method for each frame of a liquid crystal display device according to the present invention.

The driving method of the liquid crystal display devices according to the present invention will now be described with reference to FIGS. 6, 7, and 8A to 8C. Referring to FIG. 6, a timing chart illustrates a gate pulse applying method for each frame of a liquid crystal display device according to the present invention. Only five scanning lines are selected for convenience sake in the FIG. 6. A gate pulse is applied twice per frame in the present invention by applying a gate pulse corresponding to the black image information, i.e., a reset image information, and then applying the next gate pulse corresponding to the actual image information, wherein a time interval exists between the instant gate pulse and the previous gate pulse. For example, in a first frame, a first reset gate pulse 126*a* corresponding to the reset image information is sequentially applied to a first scanning line $G_1$. Subsequently a first actual image gate pulse 128*a* corresponding to the actual image information is sequentially applied to the first scanning line $G_1$, wherein a time interval exists between the first reset gate pulse 126*a* and the first actual image gate pulse 128*a*. In a second frame, a second reset gate pulse 126*b* and a second actual image gate pulse 128*b* are sequentially applied to the first scanning line $G_1$ in a same way as in the first frame. When observed at an instant between "T1" and "T2", the second actual image gate pulse 128*b* at a third scanning line $G_3$ and the second reset gate pulse 126*b* at a fifth scanning line $G_5$ are simultaneously in an "on-state" and are overlapped with each other to a certain degree. As shown in the FIG. 6, a first section is a section from the start point of the first reset gate pulse 126*a* in a frame to a start point of the first actual image gate pulse 128*a* in the frame. A second section is a section from a start point of the first actual image gate pulse 128*a* in the frame to a start point of the second reset gate pulse 126*b* in a next frame. The first and second sections control a size of a region of a whole frame to which a black data, i.e., a reset data, is applied. For example, if the first section is equivalent to one-third of a total section of a frame, the number of scanning lines to which the black data for reset is applied equals one-third of a total number of the scanning lines. Accordingly, the scanning lines corresponding to the one-third of the total number of scanning lines to which the black data was applied, move sequentially downward as a time passes by. Accordingly, a motion picture can be displayed without blurred motion through repeating this movement of the scanning lines, to which the black data is applied, from upper scanning lines to lower scanning lines.

Restrictive conditions and design methods for the first and second sections are as follows. First, each of the first section and the second section should be longer than a response time of the liquid crystal so that the driving method of the present invention can be effectively adapted to a liquid crystal display device. Second, the first section and the second section should be desirably selected considering a luminance and the motion blur, the effects of which are inversely proportional to each other. For example, as the first section increases, the motion blur phenomenon decreases but the luminance correspondingly decreases. As the second section increases, the luminance increases but the blurred motion phenomenon increases.

Conventionally, when the gate pulse is applied to one scanning line and then sequentially to the next scanning line in a frame, two gate pulses of two arbitrary scanning lines are simultaneously provided in an "on-state" and are overlapped to a certain degree. Specifically, at the instant between "T1" and "T2" where the second reset gate pulse 126*b* of the fifth scanning line $G_5$ and the second actual image gate pulse 128*b* of the third scanning line $G_3$ are overlapped, a pixel voltage of the scanning lines, to which the second actual image gate pulse is to be applied, is pre-charged. A conventional basic pulse width, wherein the gate pulse is applied to each scanning line one at a time, depends only on a resolution and thus satisfies the following expression of equality:

A basic pulse width=Time period for a frame/A number of gate lines

According to the present invention, however, the reset gate pulse and the actual image gate pulse satisfy the following expression of equality:

A basic pulse width=(A width of a reset gate pulse+A width of an actual image gate pulse)−width of overlapped pulse of a reset gate pulse and an actual image gate pulse It is important that the width of the reset gate pulse be wide enough to reset the pixel before the actual image data is applied to each pixel. The width of the reset gate pulse should be decided considering the design restrictions of the thin film transistor. In addition, it is important that the overlapped pulse width of the reset gate pulse and the actual image gate pulse be designed so as to adequately pre-charge the pixels of the scanning line to which the actual image gate pulse is applied before applying the actual image data to the pixels. In addition, the width of the actual image gate pulse should be designed to have enough pulse width to apply each gray level data to the pixel with a pulse width except the reset gate pulse and the overlapped pulse width. Therefore, it is desirable to design each pulse width considering each design condition described above.

In the conventional impulsive type liquid crystal display device, the gate pulse is applied to the scanning line twice in a frame by making the gate pulse width half of the hold type liquid crystal display device such that the two gate pulses are not overlapped. Accordingly, the impulsive type liquid crystal display device greatly depends on a mobility of the thin film transistor elements. In the present invention, however, the two gate pulses are overlapped between two spaced scanning lines at any arbitrary moment. Thus, the pixel voltage to the pixels, to which the actual image information is to be applied, can be pre-charged.

Figure 7:
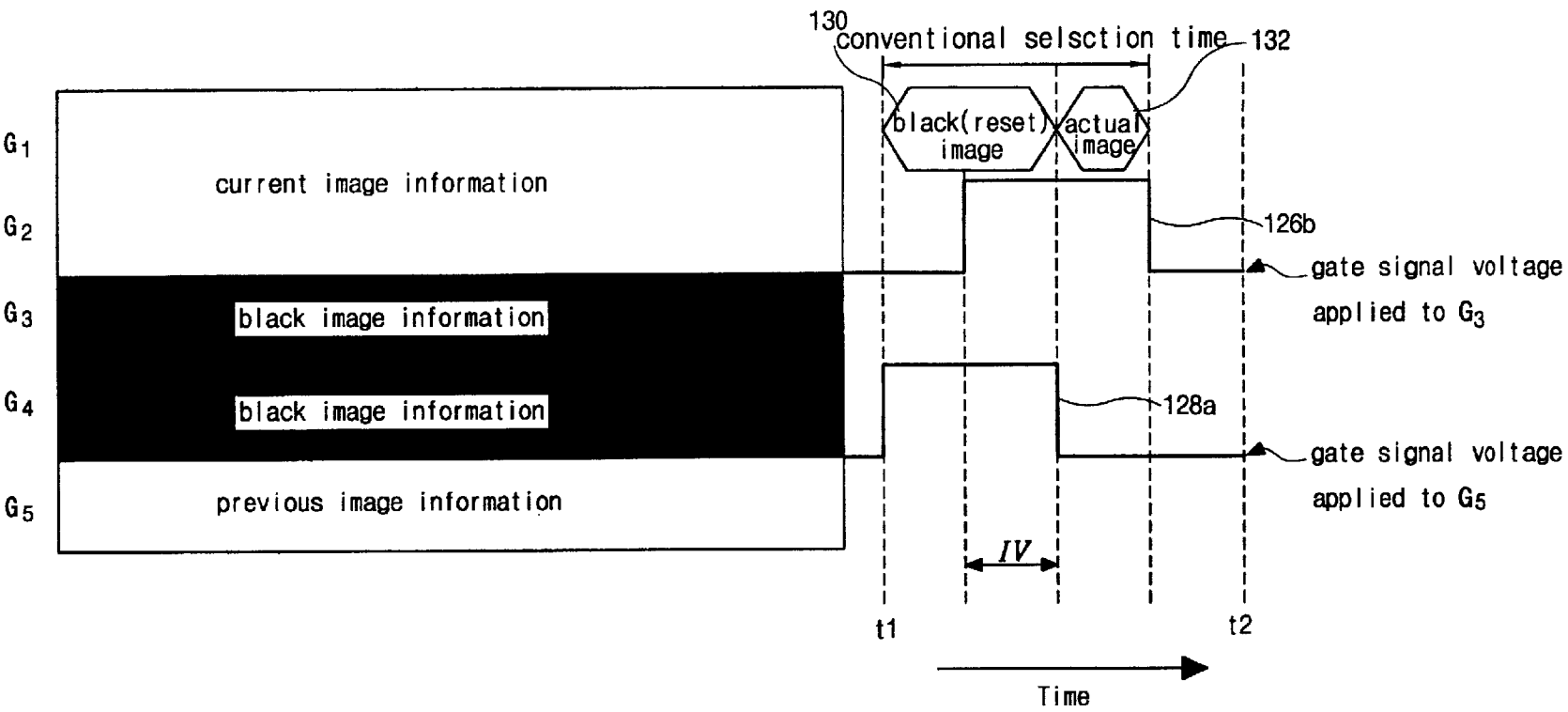
FIG. 7 is a view illustrating image formation display according to each scanning line at "T1" of FIG. 6 and illustrating a timing chart of gate pulse that is applied to arbitrary two scanning line between "T1" and "T2" according to the present invention.

Referring to FIG. 7, a view illustrates the image information display according to each scanning line at "T1" of FIG. 6 and illustrates a timing chart of gate pulse that is applied to two arbitrary scanning lines between "T1" and "T2", according to the present invention. Referring to FIG. 6 and FIG. 7, at the instant time, "T1", the previous frame is displaying the actual image information on the fifth scanning line $G_5$ by the first actual image gate pulse 128*a*, and the black image information is being displayed on the third and fourth scanning lines $G_3$ and $G_4$ by the second reset gate pulse 126*b*, and the actual image information is being displayed on the first and second scanning lines $G_1$ and $G_2$ by the second actual image gate pulse 128*b*. The black image information in FIG. 7 moves downward keeping a uniform interval as time passes. The timing chart of the gate pulse, which is drawn in the right side of FIG. 7, shows gate signal voltage that is applied to the third scanning line $G_3$ and the fifth scanning line $G_5$. The second reset gate pulse 126*b* is in an "on-state" on the fifth scanning line $G_5$ and the second actual image gate pulse 128*b* is in an "on-state" on the third scanning line $G_3$. The black image data 130, i.e., a reset image data, by the second reset gate pulse 126*b* is also applied to an overlapped section between the second reset gate pulse 126*b* and the second actual image gate pulse 128*b*. Thus, the actual image data 132 in a non-overlapped section can be successively applied right after the black image data 130 resulting in an increase of the data processing speed.

Figure 8A:
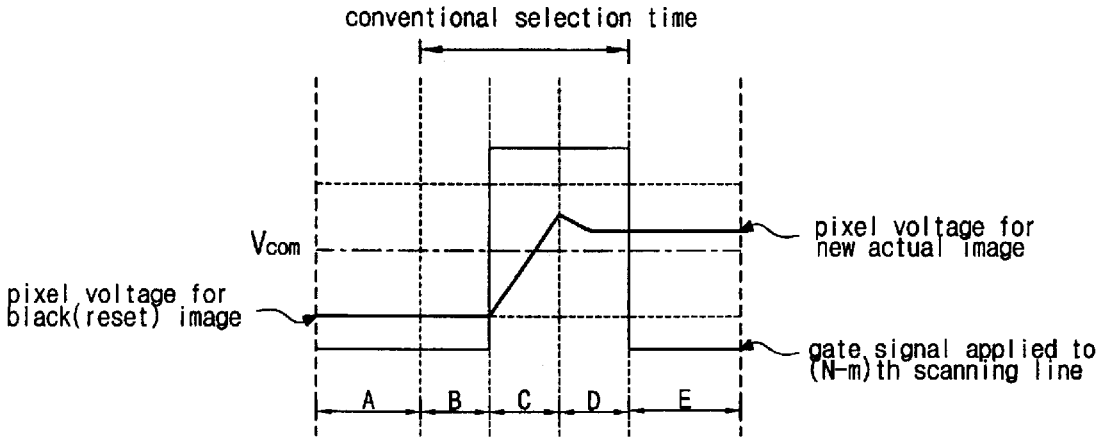
FIGS. 8A to 8C are timing charts illustrating an example of driving curves of each signal voltage according to the present invention.
Figure 8B:
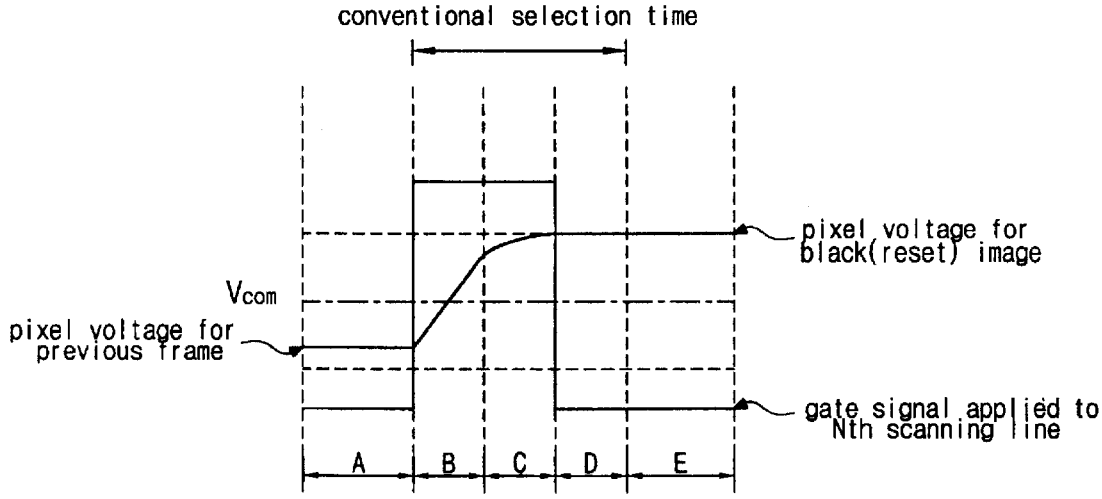
Figure 8C:
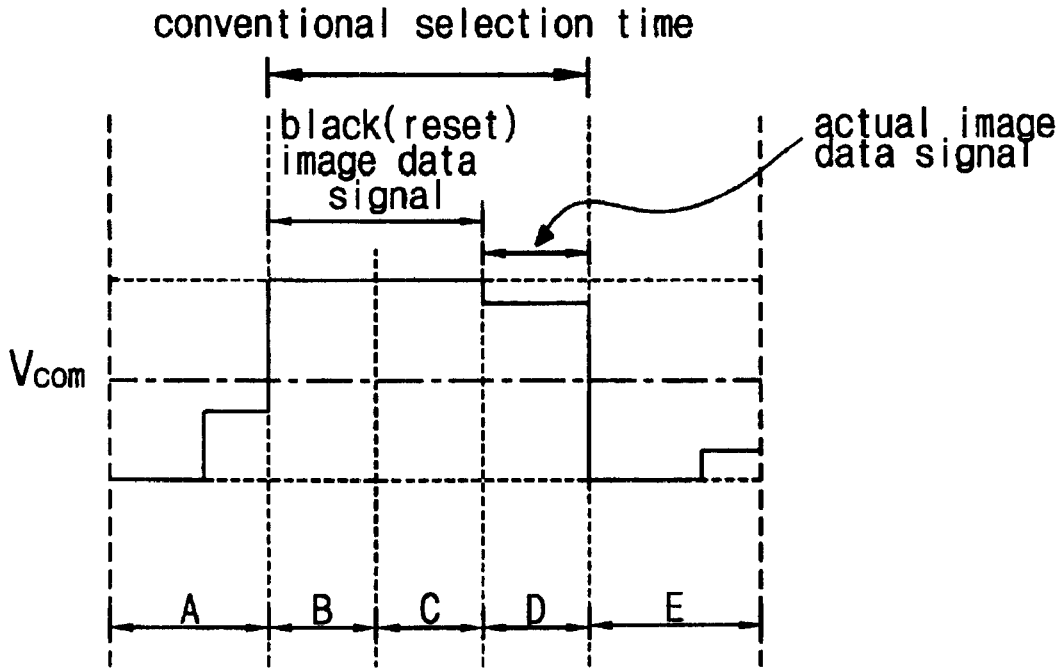

Referring to FIGS. 8A to 8C, timing charts illustrate examples of driving curves for each signal voltage according to the present invention. Specifically, FIGS. 8A and 8B illustrate gate signals which are respectively applied to a $(N-m)_{th}$, scanning line and $N_{th}$ scanning line in addition to the application of pixel voltage according to an elapse of time in selected pixels of the $(N-m)_{th}$ scanning line and the $N_{th}$ scanning line. FIG. 8C illustrates a driving curve of a data signal voltage according to an elapse of time in a data line on which the selected pixel of FIG. 8A and FIG. 8B exist. The data signal voltage applied through the data integrated circuit has a difference to a certain degree from a pixel voltage applied to the pixel because of a resistance between lines in the course of arriving at the pixel or a parasitic capacitance in a portion of the thin film transistor.

In FIGS. 8A–8C, "N" is a positive integer which represents the total, or less than the total, number of all the scanning lines and "m" is a positive integer that represents the total number of scanning lines that have the black image information. In FIGS. 8A and 8B, there exists a moment when the gate signal of the $N_{th}$ scanning line and the gate signal of the $(N-m)_{th}$ scanning line are overlapped. That is, in a section "B+C" of FIGS. 8A and 8B, a black image pixel voltage, triggered by the gate signal of the $N_{th}$ scanning line, is applied to the pixel of the $N_{th}$ scanning line and the black image pixel voltage is also applied to the pixel of the $(N-m)_{th}$ scanning line corresponding to the overlapped section of the gate signal. Referring to sections "A" and "E" of FIGS. 8A and 8B, because the gate signal is in an "off-state", the actual image information of the previous frame is displayed in the section "A" of FIG. 8B and a new actual image information of the next frame is displayed and maintained in the section "E" of FIG. 8A until a next reset gate signal is applied to the $(N-m)_{th}$ scanning line. If a new actual image data signal voltage starts to be applied to the $(N-m)_{th}$ scanning line in section "D" of FIGS. 8A and 8C, after the black image data signal voltage is applied the $(N-m)_{th}$ scanning line, the actual image data signal voltage is pre-charged by the black image data signal voltage in the section "C" of FIG. 8B and thus the pixel voltage of the corresponding pixels can be charged fast. A size of the pixel voltage, which starts from an end of the section "C" of FIG. 8A, depends on the overlapping time of two gate signals in the section "C" of FIGS. 8A and 8B. It is desirable to make the overlapping time long enough to obtain adequate charging from the black image data having a negative polarity to a gray level having a positive polarity. The data signals are respectively applied to the $(N-M)_{th}$ scanning line and $N_{th}$ scanning line and should have the same polarity so that the pre-charging effect of the actual image data can be obtained. Both of a dot inversion method in which neighboring pixels have a different polarity and an inversion method in which pixels in a same row or a column have the same polarity, can be adapted to the driving of the data signal voltage.

Because the time allocated to the actual image section 132 of FIG. 7 during the selection time is reduced, the data signal processing speed according to the present invention is faster than that found conventionally. As described before in FIG. 5, the line memory 112 of FIG. 5 divides the data signal into several components of data signals and applies those components to the data integrated circuit 104 of FIG. 5. When the data information applied to the corresponding pixels of the $(N-m)_{th}$ and $N_{th}$ scanning lines that have an "on-state" gate signal are the same, a minimization of the pre-charging time can be achieved in terms of the luminance.

It will be apparent to those skilled in the art that various modifications and variation can be made in the liquid crystal display device and the driving method of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel including a plurality of scanning lines, a plurality of signal lines, a first substrate, a second substrate, and a liquid crystal layer interposed between the first substrate and the second substrate, the scanning line receiving a gate signal, the signal line receiving a data signal and defining a pixel region by crossing the scanning line, the first substrate including a switching element that is connected to the scanning line and the signal line, the second substrate including a common electrode;

a gate integrated circuit and a data integrated circuit for applying the gate signal and the data signal, respectively, to the scanning line and the signal line, respectively; and a controller for outputting a gate start pulse for a reset image information and a gate start pulse for an actual image information to the gate integrated circuit at least once in a frame and for controlling a gate pulse for the reset image information and a gate pulse for the actual image information to be overlapped between two spaced scanning lines at an arbitrary moment.

2. The device according to claim 1, wherein the liquid crystal display device further includes a line memory that stores the data signal of the controller and outputs the stored data signal to the data integrated circuit by dividing the data signal into at least two data signals and wherein the controller outputs at least two data start pulses to each data integrated circuit, the at least two data start pulses correspond the at least two data signals.

3. The device according to claim 2, wherein the line memory outputs the data signal to the data integrated circuit by dividing the data signal into three data signals.

4. The device according to claim 1, wherein the liquid crystal is an optically compensated birefringence (OCB) mode liquid crystal that shows a bent stricture when a voltage is applied.

5. The device according to claim 1, wherein the liquid crystal panel operates in a normally white mode.

6. The device according to claim 1, wherein the reset image information is black image information.

7. A driving method of a liquid crystal display device comprising:

applying a reset image data signal to a plurality of pixels by sequentially applying a first gate pulse corresponding to a reset image information to a plurality of scanning lines in a first frame; and controlling the first gate pulse and a second gate pulse to be overlapped between two spaced scanning lines at an arbitrary moment in the first frame when the second gate pulse corresponding to an actual image information is sequentially applied to each scanning line with a certain time interval from the first gate pulse at the frame.

8. The method according to claim 7, further including controlling a reset image data signal to be applied to an overlapped section of the first gate pulse and the second gate pulse, and controlling an actual image data signal to be successively applied to a non-overlapped section of the second gate pulse.

9. The method according to claim 7, wherein a voltage that is applied to pixels of the overlapped section serves to pre-charge successive actual image information.

10. The method according to claim 7, wherein the reset image information is black image information.

11. The method according to claim 7, wherein the first gate pulse precedes the second gate pulse.

12. The method according to claim 11, wherein a size of a region in which the black image is displayed in a whole screen is controlled by a ratio between a first section and a second section, the first section is a section from a start point of the first gate pulse to a start point of the second gate pulse in a frame and the second section is a section from a start point of the second gate pulse in the frame to a start point of the first gate pulse in a next frame.

13. The method according to claim 12, wherein a size of the first section and a size of the second section are different from each other.

14. The method according to claim 12, wherein both of the first section and the second section are respectively longer than a response time of liquid crystal.

15. The method according to claim 7, wherein a reset image data and an actual image data, which are applied to the pixels to which the first gate pulse and the second gate pulse are applied, have a same polarity each other.

16. The method according to claim 7, wherein a width of the first gate pulse has enough width to pre-charge the reset image data, and the reset image data is simultaneously applied to the scanning line to which the first gate pulse is applied and the scanning line to which the second gate pulse is applied in the overlapped section of the first gate pulse and the second gate pulse, and the actual image data is applied to the pixels of the scanning line to which the second gate pulse is applied in the section where only the second gate pulse is applied.

17. The method according to claim 16, wherein the width of the first gate pulse and a width of the second gate pulse are different from each other.

* * * * *